United States Patent [19]

Dassetto

[11] Patent Number: 5,042,449

[45] Date of Patent: Aug. 27, 1991

[54] METHOD AND RELATED SYSTEM FOR CONTROLLING THE IGNITION IN INTERNAL COMBUSTION ENGINES, PARTICULARLY DIRECT-IGNITION ENGINES WITH INDIVIDUAL COILS

[75] Inventor: Alessandro Dassetto, Turin, Italy

[73] Assignee: Fiat Auto S.p.A., Turin, Italy

[21] Appl. No.: 452,933

[22] Filed: Dec. 19, 1989

[30] Foreign Application Priority Data

Dec. 22, 1988 [IT] Italy ..... 68143 A/88

[51] Int. Cl.[5] ..... F02P 15/08

[52] U.S. Cl. ..... 123/641; 123/630; 123/643

[58] Field of Search ..... 123/641, 643, 630, 636, 123/637, 645, 198 D, 621, 622, 615, 414, 620, 416, 479

[56] References Cited

U.S. PATENT DOCUMENTS

| | | | |
|---|---|---|---|
| 4,485,784 | 12/1984 | Fujii et al. | 123/416 |
| 4,499,875 | 2/1985 | Katayama et al. | 123/416 |
| 4,502,447 | 3/1985 | Schnürle et al. | 123/479 |
| 4,562,823 | 1/1986 | Moritugu et al. | 123/620 |
| 4,597,373 | 7/1988 | Andreasson | 123/630 |
| 4,664,082 | 5/1987 | Suzuki | 123/630 |
| 4,681,082 | 7/1987 | Onogi et al. | 123/643 |
| 4,711,227 | 12/1987 | Li et al. | 123/630 |
| 4,718,395 | 1/1988 | Iwata | 123/615 |
| 4,742,811 | 5/1988 | Okada et al. | 123/643 |
| 4,757,798 | 7/1988 | Sasaki | 123/643 |
| 4,886,029 | 12/1989 | Lill et al. | 123/630 |

FOREIGN PATENT DOCUMENTS

| | | |
|---|---|---|
| 2480359 | 4/1981 | France . |
| 2536467 | 11/1984 | France . |

OTHER PUBLICATIONS

Patent Abstracts of Japan, vol. 7, No. 85 (M-206) [1230], Apr. 9, 1983; JP-A-58 10 163.

Patent Abstracts of Japan, vol. 9, No. 219 (M-410) [1942], Sep. 6, 1985; JP-A-60 79 173.

Patent Abstracts of Japan, vol. 10, No. 238 (M-508) [2294], Aug. 16, 1986; JP-A-61 70 152.

European Search Report, Feb. 1990.

*Primary Examiner*—Raymond A. Nelli

*Attorney, Agent, or Firm*—Sughrue, Mion, Zinn, Macpeak & Seas

[57] ABSTRACT

Upon starting or in the event of a malfunction of the sensor for detecting the stage of the engine, the ignition in the various cylinders is controlled according to a sequence different from that used during normal operation. In the case of engines with odd numbers of cylinders, the sequence is completed in a rotation of the driving shaft through 360° and acts on only one cylinder at a time; in the case of engines with even numbers of cylinders, the sequence is completed in a rotation of the driving shaft through 720° and involves a pair of cylinders at a time.

11 Claims, 8 Drawing Sheets

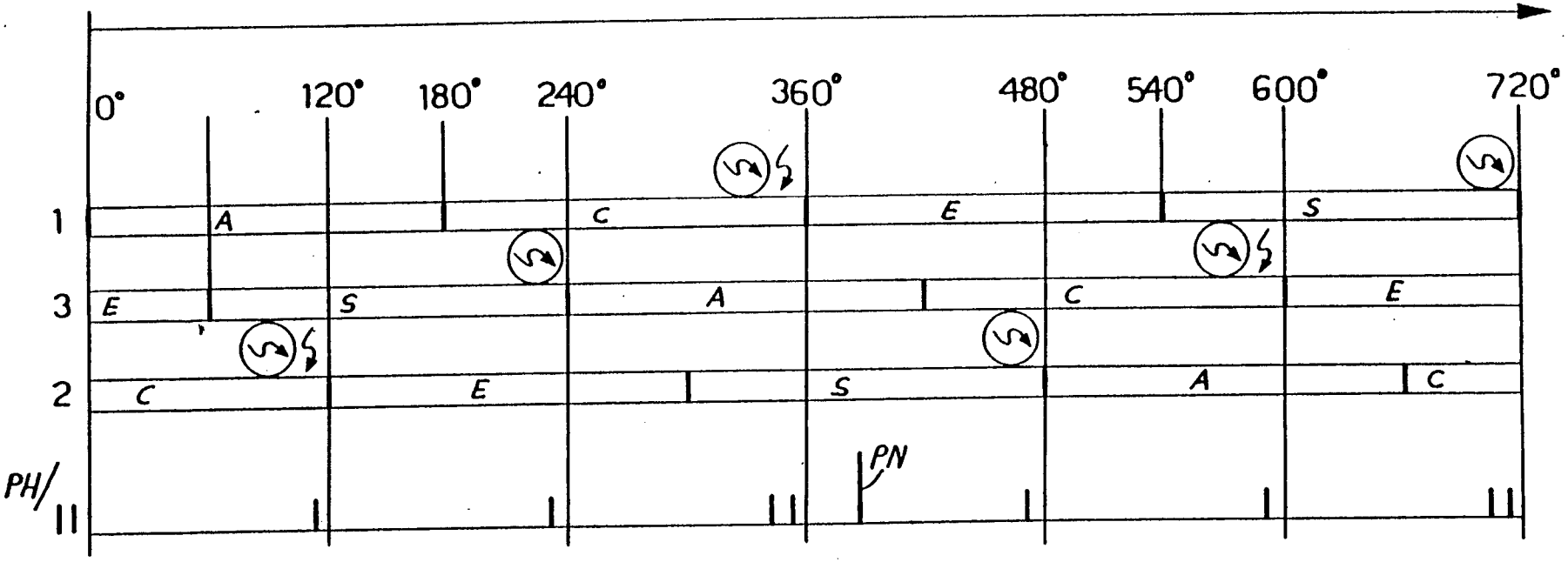
FIG. 2 - 3-CYLINDER ENGINE

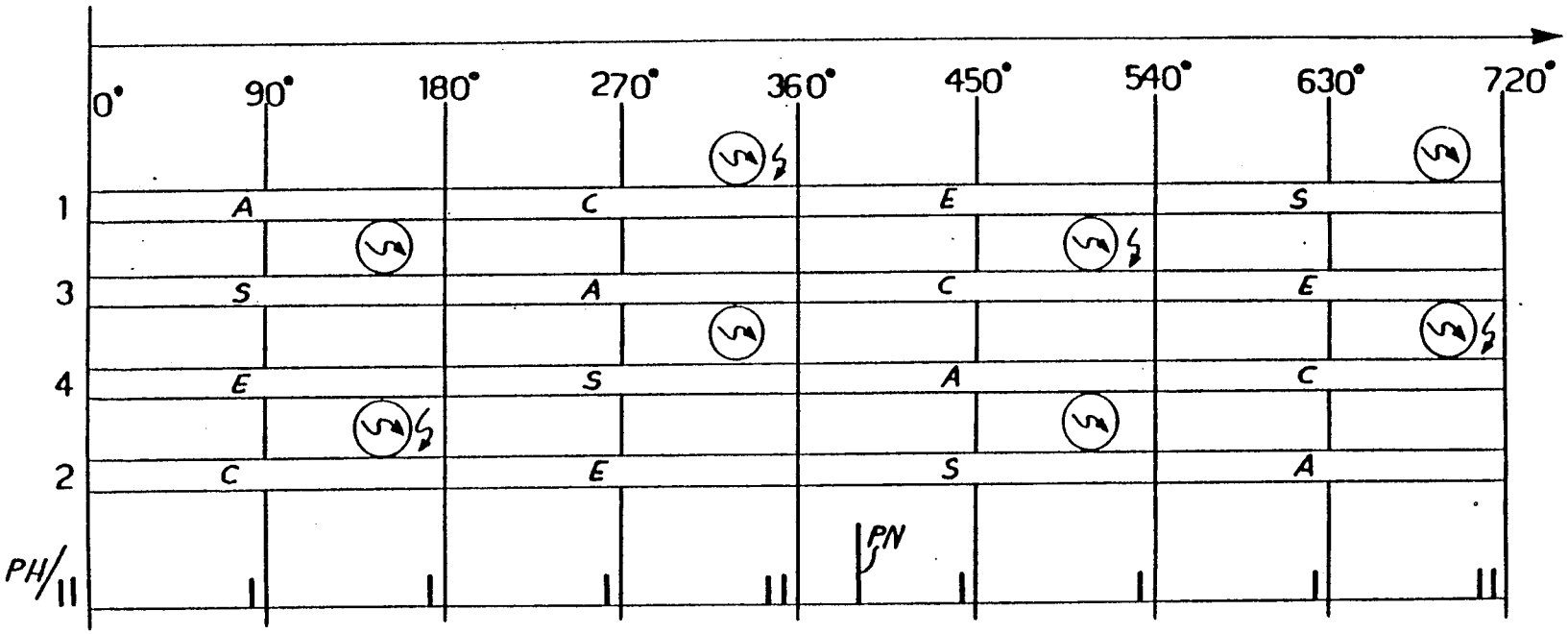
FIG. 3 - 4-CYLINDER ENGINE

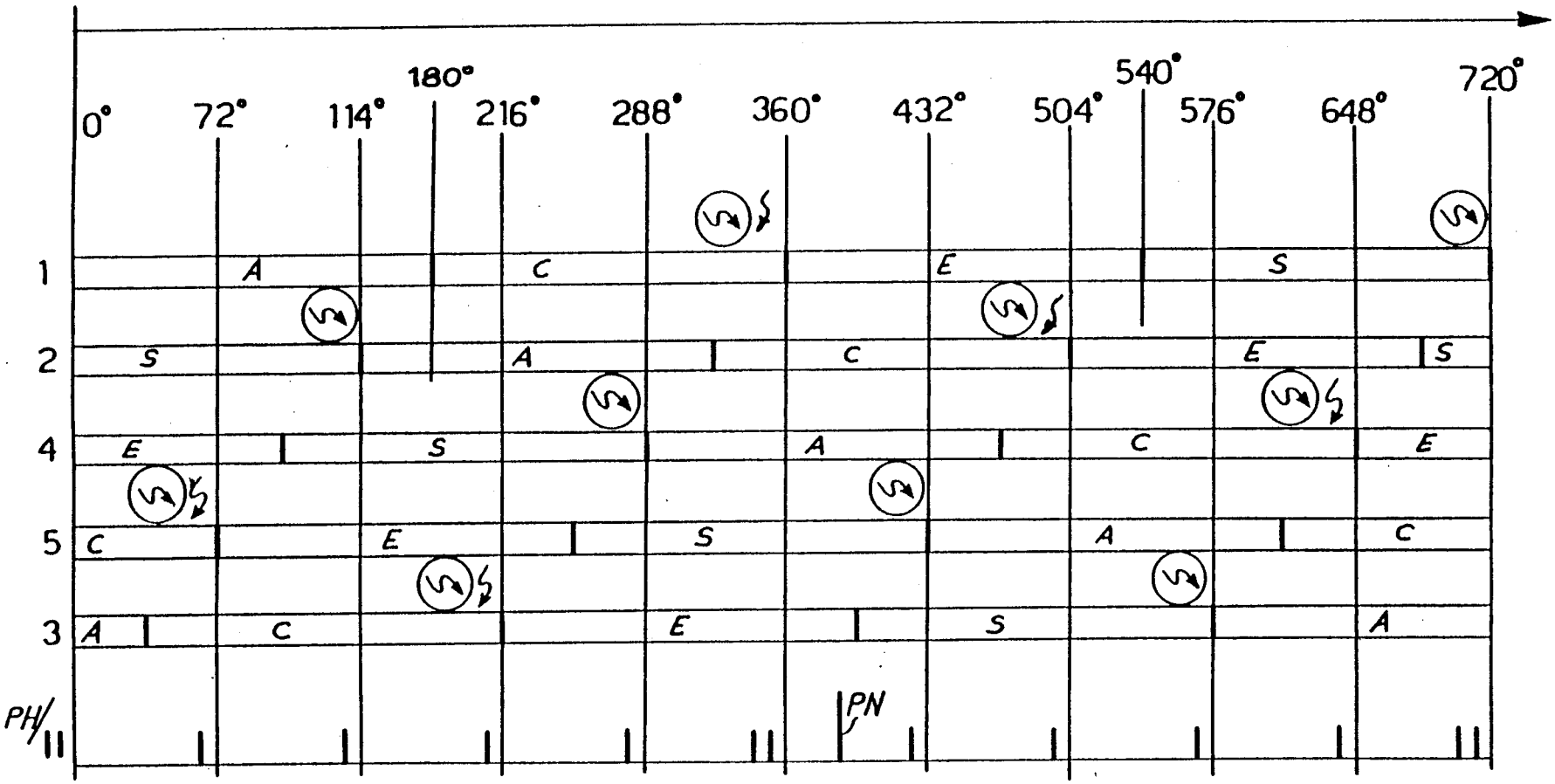
FIG. 4 - 5-CYLINDER ENGINE

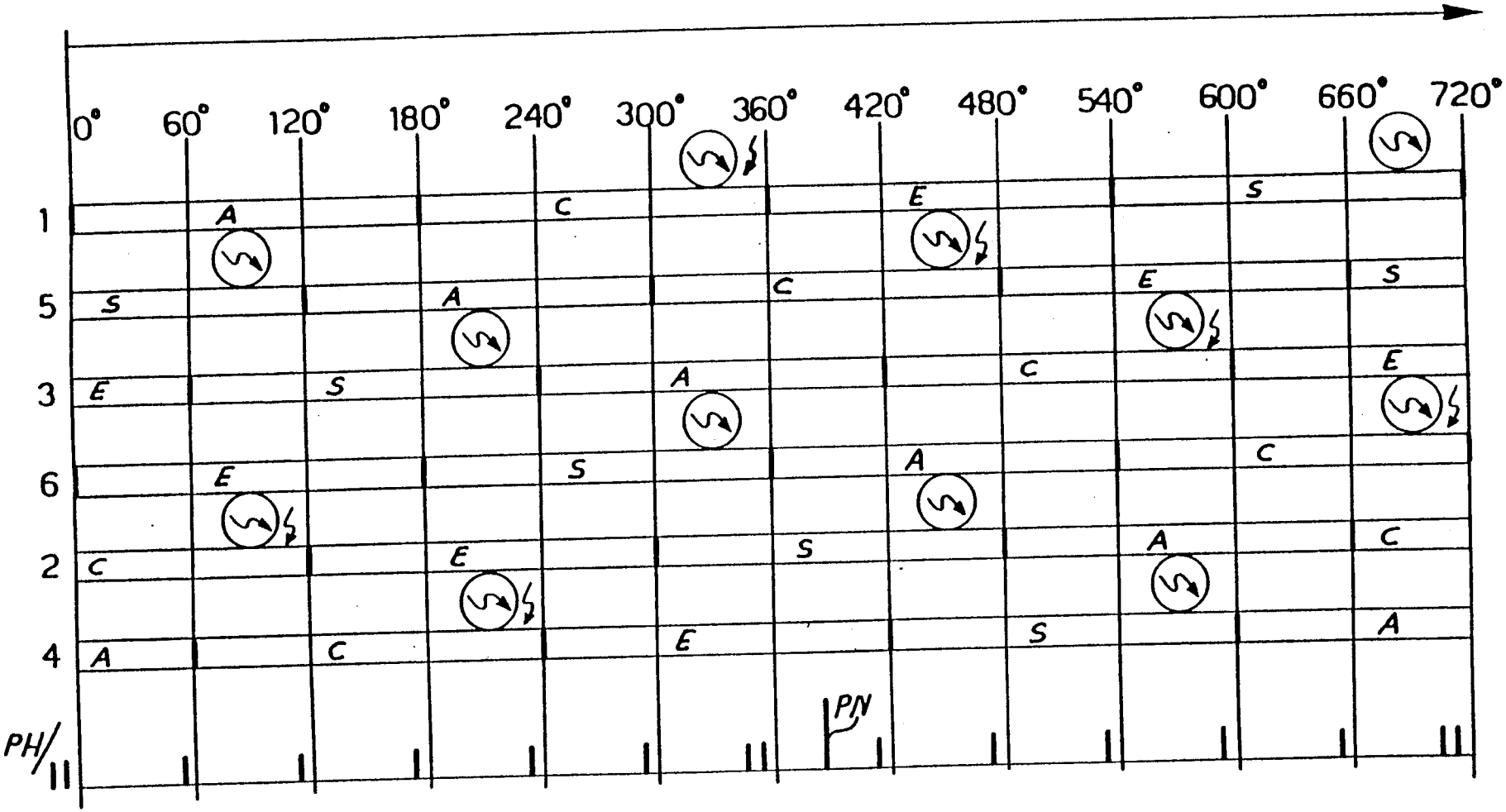
FIG. 5 - 6 CYLINDER ENGINE

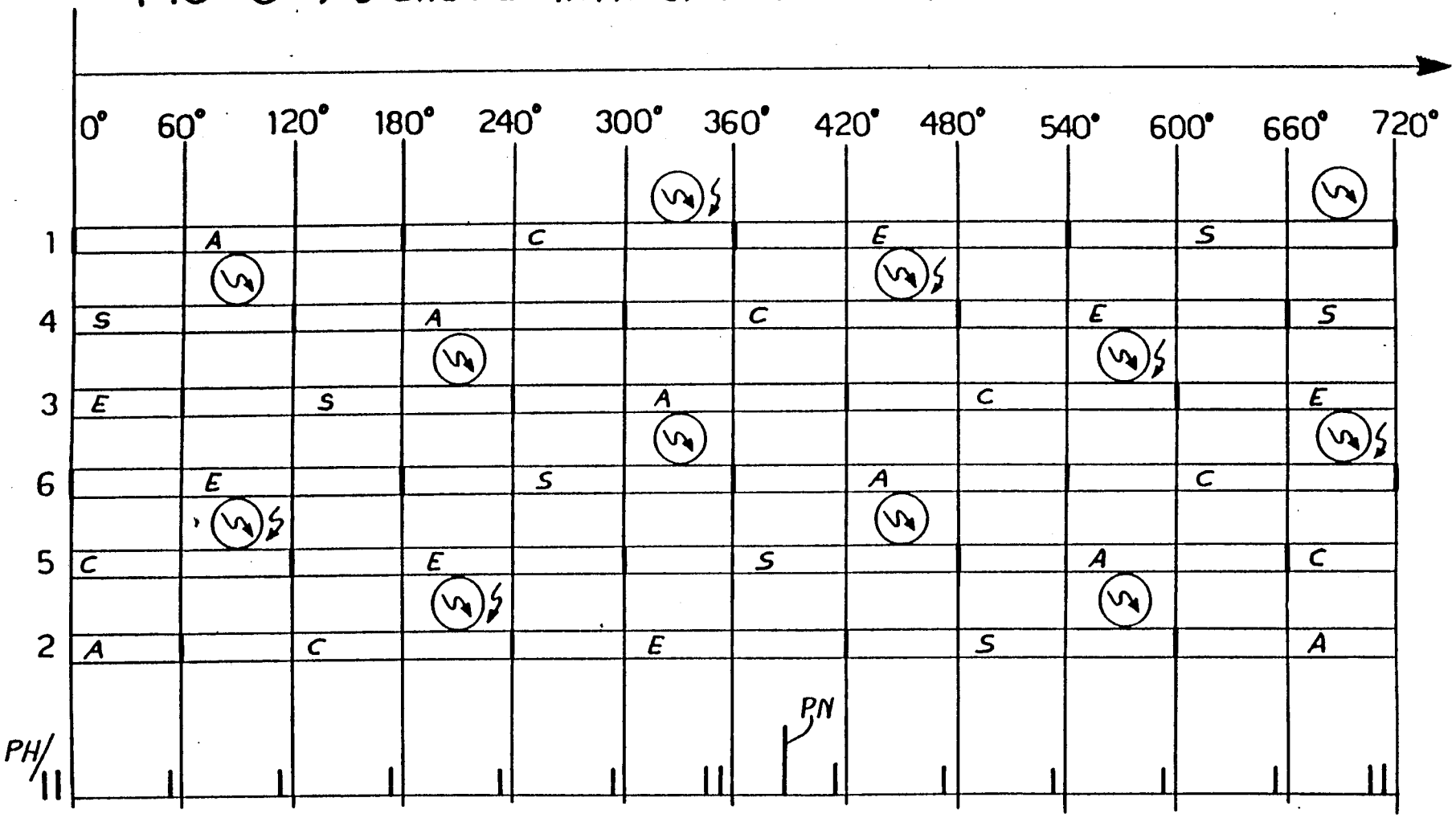
FIG. 6- V-6 ENGINE WITH CYLINDERS AT 60°

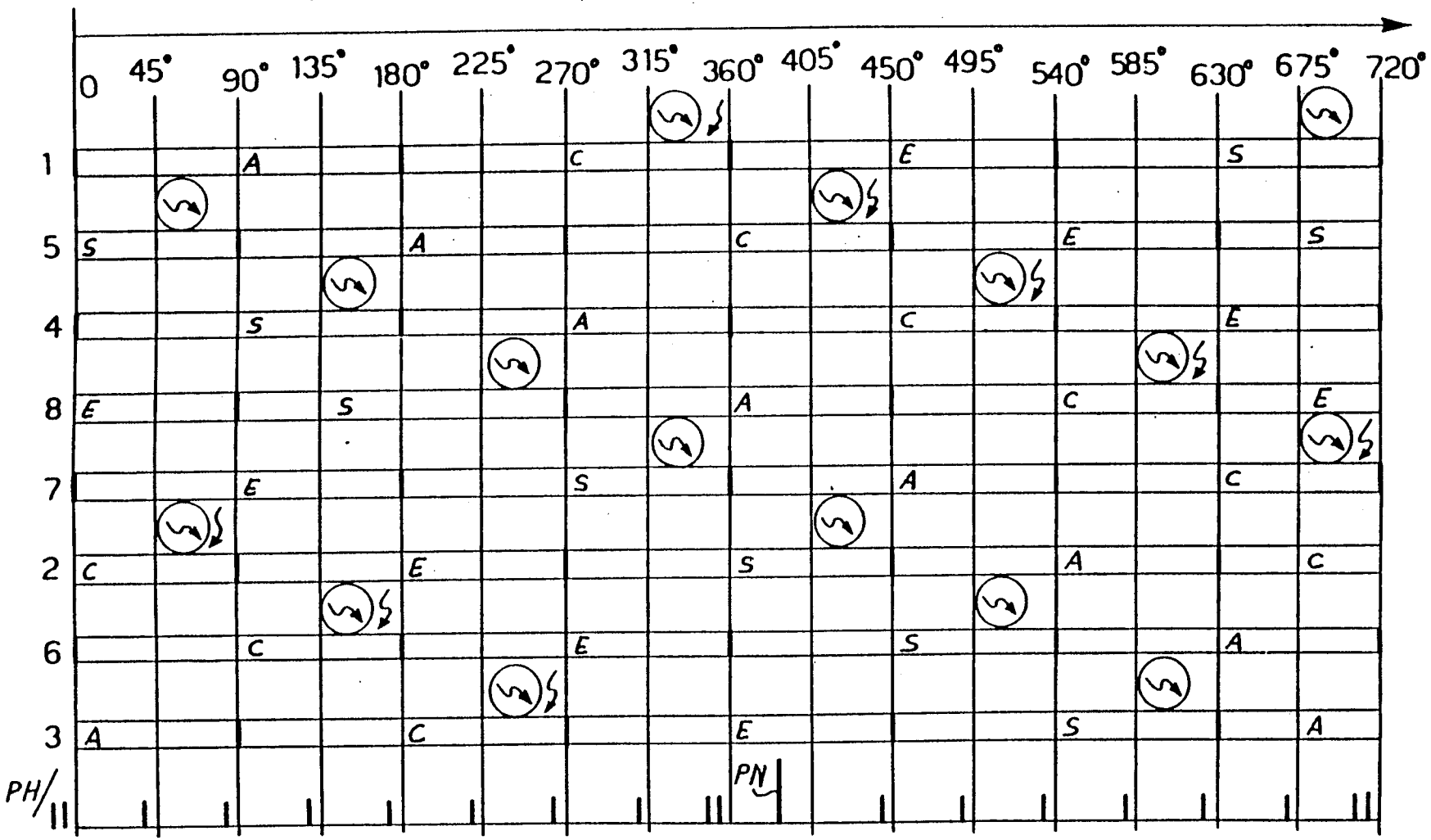
FIG. 7- V-8 ENGINE WITH CYLINDERS AT 90°

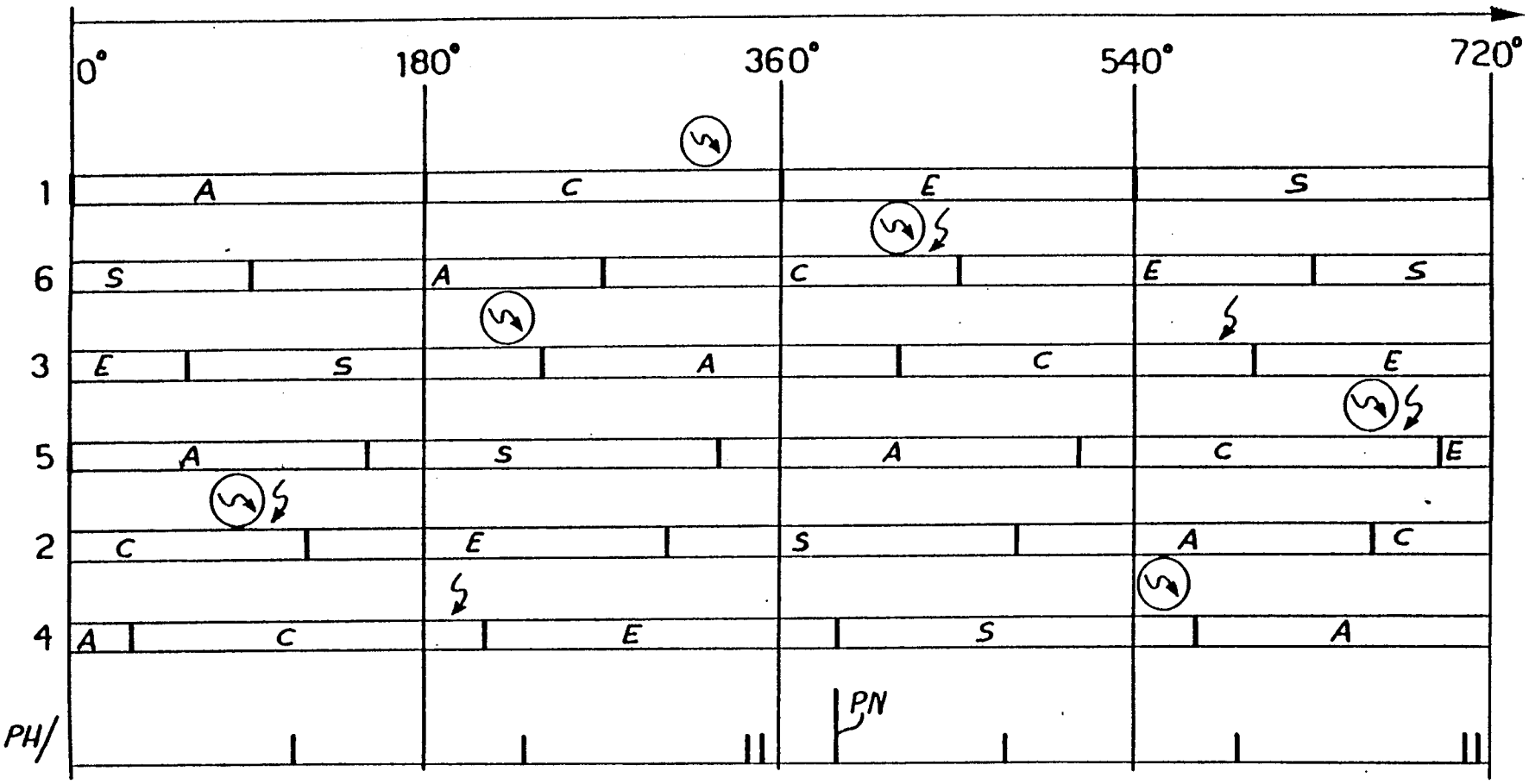
FIG. 8 - V-6 ENGINE WITH CYLINDERS AT 90° ("GALLOPING")

METHOD AND RELATED SYSTEM FOR CONTROLLING THE IGNITION IN INTERNAL COMBUSTION ENGINES, PARTICULARLY DIRECT-IGNITION ENGINES WITH INDIVIDUAL COILS

DESCRIPTION

The present invention relates in general to electronic ignition systems for internal combustion engines and has been developed with a view to its preferred use in the field of direct-ignition engines with individual coils.

In order to generate ignition sparks in the correct sequence, direct-ignition systems with individual coils (one per cylinder) require a stage signal which is usually supplied by a sensor associated with a timing member (typically the valve-operating shaft). If the detection of the signal of the stage of the engine cycle is interrupted or disturbed (for example, as a result of the breakdown or disconnection of the relevant sensor or, in the case of electromagnetic sensors, due to the establishment of a gap between the sensitive element of the sensors and the phonic wheel greater than the permitted tolerance), the correct generation of the spark is prevented, causing the engine to stop. The same problem arises during the starting stage at slow running rates, when the stage sensor is functioning correctly but does not succeed in generating stage pulses of sufficient amplitude.

In the previous patent application No. 67176-A/85 by the same Applicant, it has already been proposed that the ignition piloting circuit (not of the individual-coil type) be acted upon in the event of damage to the driving shaft speed and stage sensor, so that ignition-control pulses are emitted at a fixed frequency (for example, 200 Hz sent to a mechanical distributor) in order to make it statistically very probable that the ignition pulses of the plugs are applied with an angle of advance acceptable for each cylinder, at least when the rate of rotation of the engine is less than a value which substantially corresponds to approximately 50% of the normal maximum rate of rotation.

Apart from any other consideration, it must be remembered that this previous solution is not generally satisfactory for an ignition system with individual coils, in which the central control unit of the system must provide not only for the correct timing of the ignition (including the advance) but also for the sequence with which the ignition must take place successively in the various cylinders.

SUMMARY OF THE INVENTION

The object of the present invention, therefore, is to provide an ignition system with individual coils which enables the starting and ensures the operation, albeit reduced, of the power unit, in the event of the non-availability of the stage signal. In order to achieve this object, the present invention is based on a solution in which, with the use of a suitable signal indicative of the rate of rotation (revolutions) of the engine and of its passage through top dead centre (TDC) generated by a sensor facing a suitable phonic wheel associated with the driving shaft, it is possible to recognize the moment at which a particular cylinder is in one of the possible top dead centre positions of its cycle so that, although the exact stroke of the cylinder is not known, an ignition strategy can be set up which can generate a series of useful sparks that cause starting.

More precisely, this object is achieved, according to the invention, by virtue of a method for controlling the ignition in internal combustion engines, particularly direct-ignition engines with individual coils, in which a given ignition sequence is generated from a single signal indicative of the stage of the cycle of the engine concomitant with a predetermined rate of rotation, in order to apply to each cylinder of the engine, under normal operating conditions, ignition sparks which are separated by an angle of rotation of the engine equal to one cycle of the engine, characterised in that it includes the steps of:

detecting at least one predetermined operating condition in which the signal indicative of the stage is disturbed or absent, and generating, in the presence of this predetermined operating condition, a modified ignition sequence in which additional sparks are applied to each cylinder of the engine at moments in time intermediate the sparks applied to the cylinder under normal operating conditions.

The invention therefore enables much less expensive stage sensors to be used, since their field of operation is restricted. Moreover, it is possible to avoid the need for delicate operations for the calibration of the sensors when they are fitted to on the engine, and in any case to avoid the "stopping" of the engine (even in the event of a failure such as to interrupt the emission of the stage signal) with the consequent possibility of continued travel, at any rate to an assistance or repair centre.

The invention will now be described, purely by way of non-limiting example, with reference to the appended drawings, in which:

BRIEF DESCRIPTION OF THE DRAWINGS

FIGS. 2 to 8 are timing diagrams which show the application of the invention to various types of internal combustion engines with different numbers of cylinders.

DESCRIPTION OF THE PREFERRED EMBODIMENTS OF THE INVENTION

Figure 1:
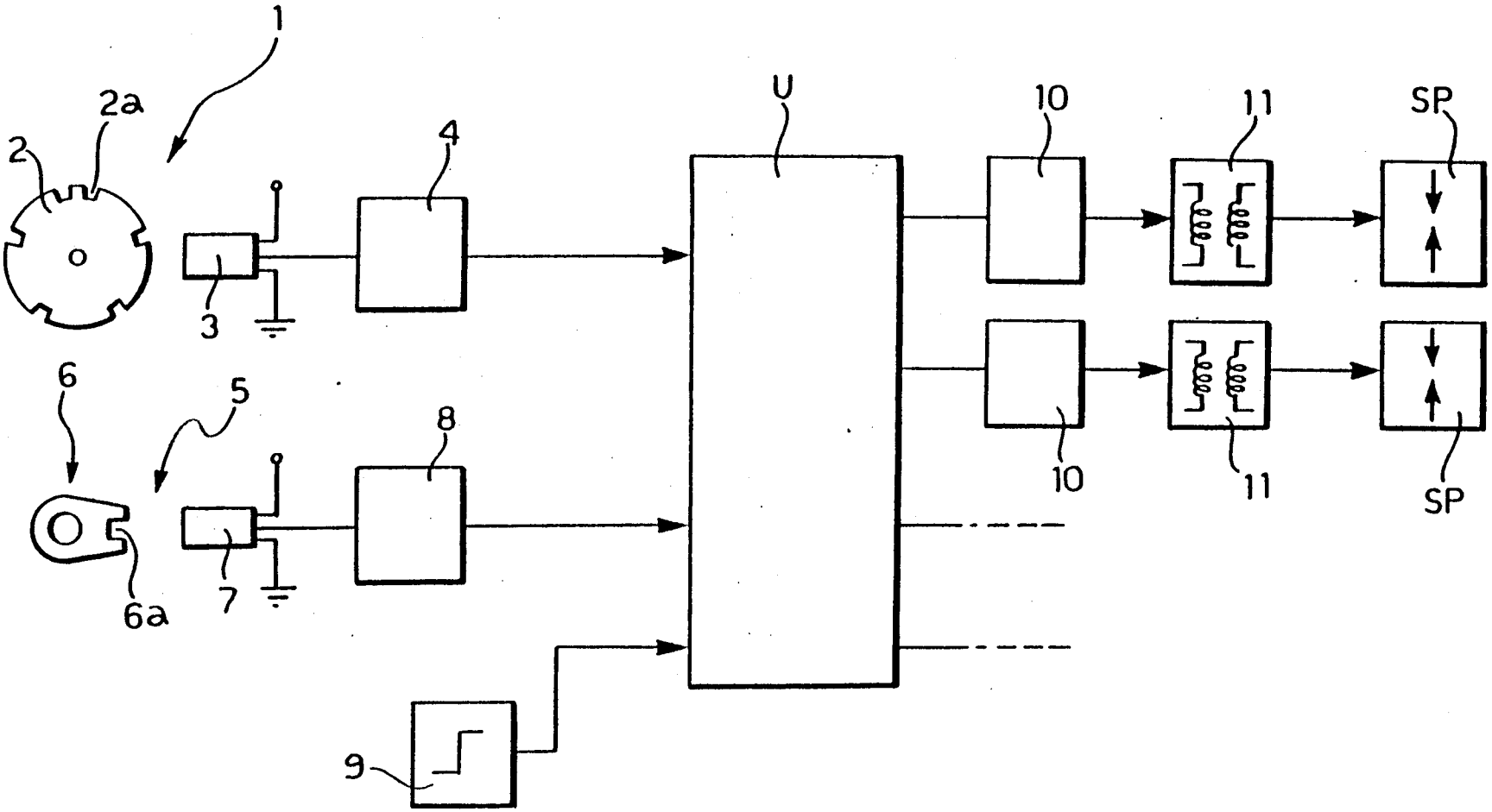
FIG. 1 shows, as a block diagram, the general structure of an ignition system for internal combustion engines which operates according to the invention.

FIG. 1 of the appended drawings shows a block diagram of a possible embodiment of an electronic ignition system of the type with individual coils, which is intended to be associated with an internal combustion engine (not illustrated) of a motor vehicle.

More specifically, an engine-shaft rotation detector is generally indicated 1 and comprises a so-called phonic wheel 2 which is rotated by the shaft and is provided with notches 2*a* (for example, as many as there are cylinders in the engine, with a double notch for indicating top dead centre (360°)) and a sensor (pick-up) 3 constituted, for example, by a proximity-effect sensor. This sensor is connected to the input of a squaring circuit, indicated 4. In operation, the phonic wheel 2 is rotated by the engine shaft and, as they pass in front of the sensor 3, the notches 2*a* cause the latter to emit pulses which are squared in the circuit 4.

The frequency of the pulses emitted by the squaring circuit 4 is indicative of the rate of rotation (that is, the number of revolutions) of the engine, whilst their position identifies the angular position of the engine: for example, it is possible to arrange for the emission of each pulse to identify the passage of a respective cylinder or respective group of cylinders through top dead centre. In other words, from the train of pulses emitted by the circuit 4, it is possible to generate a time base (or, more correctly, an "engine rotation angle" base) which constitutes the abscissa scales of the diagrams of FIGS. 2 to 8.

Another detector, indicated 5, is also constituted by a phonic wheel 6 which has at least one notch 6*a* and is mounted on a timing member, such as, for example, the camshaft for operating the valves, and a respective associated proximity sensor 7 connected to the input of a squaring circuit 8.

A further sensor is indicated 9 in FIG. 1 and can detect an operating threshold of the engine given, for example, by the temperature of the coolant. The function of the sensor 9 is essentially to provide a signal which (for reasons which will made clear below) enables it to be established whether the engine is still in the starting-up stage or whether it has reached a steady running condition.

The criteria for the production of all the elements 1 to 9 described hitherto are widely known in the art and do not therefore need to be described in greater detail.

The outputs of the squaring circuits 4 and 8 and of the sensor 9 are connected to an operating and control unit U (the so-called central control unit) which is arranged to activate the sparking plugs SP in the cylinders of the engine with an advance which is variable in dependence on the operating conditions of the engine. In known manner, the activation of the plugs SP takes place through power stages 10, for example with transistors, which act on the primary windings of respective transformers 11 equal in number to the number of plugs SP (individual-coil ignition).

The function of the unit U is to generate, from the pulses emitted by the detectors 1 and 5, the excitation pulses which are intended to produce the ignition sparks.

For this purpose, the unit U is provided with as many output lines as there are plugs in the engine.

According to wholly known criteria, the ignition sparks are produced (with the correct advance which is variable according to the operating conditions) so as to cause ignition in each cylinder upon completion of the stroke of compression of the air-fuel mixture.

The diagrams of FIGS. 1 to 8 refer in order to:

a three-cylinder engine (FIG. 2),
a four-cylinder engine (FIG. 3),
a five-cylinder engine (FIG. 4),
a six-cylinder engine (FIG. 5),
V-6 engine with cylinders at 60° (FIG. 6),
V-8 engine with cylinders at 90° (FIG. 7). and
another V-6 engine with cylinders at 90° (FIG. 8).

Each of the diagrams shows, for each cylinder, the sequence of the four strokes of intake (A), compression (C), power or explosion (E), and exhaust (S) characteristic of a normal four-stroke engine, as a function of the angular scale on the abscissa (the angle of rotation of the engine). If read from the top downwards, the diagrams show the ignition sequence of the cylinders.

Thus, for example, in the case of the three-cylinder engine of FIG. 2, the expected ignition sequence is: first cylinder, third cylinder, second cylinder, first cylinder, and so on, cyclically.

In the case of the five-cylinder engine of FIG. 4, the sequence is as follows: first cylinder, second cylinder, fourth cylinder, fifth cylinder, third cylinder, first cylinder, etc. cyclically. The various six-cylinder engines to which FIGS. 5, 6 and 8 relate are distinguished from each other by their different ignition sequences.

A spark symbol in the diagrams indicates the position at which the unit U causes the application of the ignition spark to each cylinder under normal operating conditions.

The bottom line of each diagram shows the train of pulses PH generated by the detector 4: each pulse is represented by a short vertical line which is double when the pulse represents the reaching of top dead centre by a particular cylinder.

It will be noted that the pulses PH are not aligned exactly with the moments at which the sparks are applied. This is because, as stated, the unit U applies the sparks with a variable advance. The stage pulse PN generated by the stage detector 5, usually at a rate of one pulse for each engine cycle (720°), however, is shown by a line of greater height.

It is clear that the availability of the stage signal PN is essential for the correct control of the ignition in a system with individual coils. The signal PN in fact indicates to which cylinder, and under what operating conditions, the immediately subsequent pulse PH corresponds. In the case of the diagram of FIG. 2, it is the second cylinder at the end of the exhaust stroke S, in the case of FIG. 4, the fifth cylinder at the end of the exhaust stroke, and so on. If the signal PN is not available, for example, due to the breakdown or disconnection of the detector 5 or due to an anomalous variation in the gap between the phonic wheel 6 and the proximity sensor 7, the ignition function can no longer be carried out correctly. This is also true in general for slow starting speeds when the rate of rotation of the engine means that the stage pulses (usually one for every rotation of the engine through 720°) are not generated with sufficient amplitude to be detected by the squaring circuit 8.

In the system according to the invention, however, the detector 1 can generate a valid signal for the central control unit U, coinciding with the passage of each cylinder through top dead centre for each revolution of the engine, even at very low starting speeds.

As soon as the central control unit U recognises the fact that the engine is under starting conditions, regardless of whether the stage signal PN is available or not, it begins to generate spark-excitation signals according to a sequence different from that provided for under normal operating conditions, but related thereto.

In the diagrams of FIGS. 2 to 8, the application of the sparks according to this modified sequence has been indicated by a spark symbol in a circle.

As can be seen from an examination of the diagrams, the modified sequence provides for an intensification of the frequency of application of the sparks, so that each cylinder receives a spark regardless each time it passes through top dead centre. As is well known, this occurs twice for each engine cycle (720°): at the end of the compression stroke (in this case the spark applied will be "right") and at the end of the exhaust stroke (in this case the spark will be "lost", without giving a useful result). Nonetheless, with this modified sequence, it is certain that the "right" spark will be applied, even if the central control unit U does not have the correct stage reference available which enables the two top dead centre points to be distinguished.

In practice, in the majority of cases (FIGS. 2 to 7), in the solution according to the invention, the central control unit U, so as to speak, intensifies the ignition sequence in each cylinder by the application of a further ignition pulse to each cylinder at an angular position halfway between two ignition pulses provided by the normal ignition sequence.

As can be deduced from FIGS. 2 and 4, in the case of engines with an odd number of cylinders (3 and 5 respectively), the sequence of application of ignition pulses to all the cylinders of the engine is completed in a rotation through 360°0 (that is, with the application of a spark to each cylinder in each half-stage of a cycle of 720°). In the case of engines with even numbers of cylinders, that is, those to which FIGS. 3 and 5 to 8 refer, the sequence is completed within 720° (that is, with the application of at least one spark to each cylinder in each stage of the cycle).

In particular, it can be seen that, in the case of the V-6 engine, which is of the so-called "galloping" type (and can be thought of in theory as resulting from the joining of two three-cylinder engines which are run with a 90° offset), the modified sequence provides for the omission of the spark which (theoretically) would come at the end of the compression stroke in cylinders 3 and 4 and its replacement by a spark at the end of the exhaust stroke.

If the detector 5 is operating correctly, the modified ignition sequence is adopted during the starting stage until the central unit U detects that the engine has reached a steady running speed. Under these conditions, the sensor 5 can certainly ensure the correct generation of the stage signal PN which enables the central unit U to change to normal operation, initiating the generation of the ignition pulses according to the normal firing sequence (the spark symbols not circled in the diagrams of FIGS. 2 to 8).

If the stage signal PN is not present when the starting threshold is exceeded, or if the stage signal disappears, the central unit U remains in, or returns automatically to, the operating condition used for starting, limiting the maximum speed which can be reached by the advance, in dependence on the signal 9, so as to minimise the dissipation of electrical energy.

In any case, although the performance of the engine is reduced, its operation will at any rate be ensured, enabling the vehicle to be brought to an assistance and repair centre (so-called "limp home"). Preferably, the application of the above modified ignition sequence may be accompanied (in engines provided with electronic injection) by a modified injection function achieved by the simultaneous excitation of all the injectors of all the cylinders every 360°, so as to ensure that the cylinders are at least charged in each stage of the cycle.

Naturally, the change from the ignition sequence used under normal conditions to the modified sequence used at low ignition rates or in the event of a failure of the detector 5 does not involve a modification of the physical structure of the central unit 1, but simply different programming thereof in accordance with criteria which are wholly known to an expert in the art and do not therefore need to be described herein.

For example, if, under normal operating conditions, an ignition pulse is emitted because the counting cycle reaches a certain value which is increased in dependence on the pulses PH according to a phased sequence of the signal PN, the pulses according to the modified sequence described above can be generated simply by the emission of the ignition pulse when a lower counting value is reached, for example, half the counting value used under normal operating conditions.

I claim:

1. A method of controlling the ignition sparks in internal combustion engines, particularly direct-ignition engines with individual coils, in which a given ignition spark sequence is generated from a signal indicative of the stage of rotation of the engine, in order to apply to each cylinder of the engine, under normal operating conditions, one ignition spark operation per engine cycle, succeeding ignition spark operations for each cylinder being separated in period by substantially one engine cycle, including the steps of:

detecting at least one predetermined operating condition in which the signal indicative of the stage of rotation of the engine is disturbed or absent, and generating, in the presence of this predetermined operating condition, a modified spark ignition sequence in which an increased number of ignition spark operations are applied to each cylinder of the engine for each engine cycle than are applied to the cylinder under normal operating conditions.

2. A method according to claim 1, wherein two ignition spark operations are applied to each cylinder of the engine per engine cycle, a first of said two ignition spark operations being applied at a first portion of the engine cycle proximate a portion of the engine cycle where an ignition spark operation is applied during said normal operating conditions, and a second being applied at a second portion of the engine cycle substantially halfway between succeeding first portions.

3. A method according to claim 1, including the steps of:

detecting the passage of a predetermined cylinder of the engine through top dead centre, and applying an ignition spark to each cylinder of the engine in accordance with the modified ignition spark sequence, in correspondence with each passage through top dead centre.

4. A method according to claim 1, for use in internal combustion engines with an old number of cylinders, wherein the modified ignition spark sequence involves the application of sparks to all the cylinders of the engine within a half-cycle.

5. A method according to claim 1, for use in engines with an even number of cylinders, wherein the modified ignition spark sequence involves the application of sparks to all the cylinders of the engine within one cycle, with the application of ignition sparks to two cylinders of the engine at the same time.

6. A method according to claim 1, wherein in at least one cylinder of the engine, the modified ignition spark sequence involves the omission of the application of the sparks which are applied under normal operating conditions.

7. An ignition system for internal combustion engines, particularly direct-ignition engines with individual coils in combination:

first sensor means for generating a signal indicative of the passage of each cylinder of the engine through top dead centre;

second sensor means for generating a signal indicative of the stage of rotation of the engine, and control means connected to the first and second sensor means and able to generate a given ignition spark sequence in order to apply to each cylinder of the engine, under normal operating conditions, ignition sparks which are separated by an angle of rotation of the engine equal to one engine cycle, the control means also being able to detect at least one predetermined operating condition in which the signal indicative of the stage is disturbed or absent and, in the presence of this given operating condition, to generate a modified ignition spark sequence in which an increased number of sparks are applied to each cylinder of the engine per engine cycle, with additional sparks of said increased number of sparks being applied at moments in time intermediate the sparks applied to the cylinder under normal operating conditions.

8. A system according to claim 7, wherein the intermediate moments in time are halfway between the sparks applied under normal operating conditions.

9. A system according to claim 7, wherein the control means apply an ignition spark to each cylinder of the engine in accordance with the modified ignition sequence, in correspondence with each passage through top dead centre.

10. A system according to claim 7, wherein the first and second sensor means comprise phonic-wheel sensors.

11. A system according to claim 7 including further sensor means which are sensitive to the temperature of the coolant of the engine, and wherein the control means generate the modified ignition sequence with coil-charging times and angles of advance which are correlated with the further sensor means.

* * * * *